US007320767B2

(12) United States Patent
Edge et al.

(10) Patent No.: US 7,320,767 B2
(45) Date of Patent: Jan. 22, 2008

(54) METHOD OF INCREASING DIMENSIONAL STABILITY OF A MAT

(75) Inventors: Barry Nelson Edge, Cowpens, SC (US); David Hershel Pullen, Simpsonville, SC (US)

(73) Assignee: Johns Manville, Denver, CO (US)

( * ) Notice: Subject to any disclaimer, the term of this patent is extended or adjusted under 35 U.S.C. 154(b) by 43 days.

(21) Appl. No.: 11/032,357

(22) Filed: Jan. 10, 2005

(65) Prior Publication Data

US 2005/0123730 A1 Jun. 9, 2005

Related U.S. Application Data

(62) Division of application No. 10/114,742, filed on Apr. 2, 2002, now abandoned.

(51) Int. Cl.
*B29C 53/18* (2006.01)
*B29B 15/10* (2006.01)

(52) U.S. Cl. ..... 264/137; 264/175; 264/257; 264/293

(58) Field of Classification Search ..... 264/134, 264/175, 257, 263, 293, 296
See application file for complete search history.

(56) References Cited

U.S. PATENT DOCUMENTS 3,071,180 A * 1/1963 Finger et al. ..... 156/519

FOREIGN PATENT DOCUMENTS

JP 6-346360 * 12/1994
JP 2001-314714 * 11/2001

* cited by examiner

*Primary Examiner*—Edmund H. Lee
(74) *Attorney, Agent, or Firm*—Robert D. Touslee

(57) ABSTRACT

A dimensionally more stable mat is made from a less dimensionally stable mat by saturating the mat with a binder and passing and compressing the mat between a pair of squeeze rolls to remove binder from the mat. At least one of the rolls has a series of annular grooves therein spaced apart along the length of the roll and across the width of the mat whereby as the mat is passed between the rolls a first and a second series of longitudinally extending bands are formed in the mat having different average binder concentrations. The second series of bands, formed in the mat at the annular grooves of the roll, has an average binder concentration greater than that of the first series of bands.

11 Claims, 3 Drawing Sheets

METHOD OF INCREASING DIMENSIONAL STABILITY OF A MAT

This application is a division of application Ser. No. 10/114,742, filed Apr. 2, 2002 now abandoned.

BACKGROUND OF THE INVENTION

The subject invention relates to a mat that is given more dimensional stability through the inclusion of binder and to the method of making the dimensionally more stable mat through a unique application of the binder to the mat.

Mats are commonly used in the roofing and other industries to reinforce laminates, membranes, shingles, roll roofing, etc. and provide these articles with dimensional stability. For example, in the roofing industry, single ply roofing membrane systems are commonly used as the roofing systems for low sloping roofs, especially in industrial and commercial applications. These single ply roofing membrane systems utilize roofing membranes that each include two thermoplastic olefin ("TPO") sheets bonded to each other and to a dimensionally stable reinforcing mat. To meet industry standards, these roofing membranes typically have a maximum linear dimensional change of plus or minus 2% as measured by ASTM D 1204, 6 hours at 158° F./70° C.; and a minimum puncture resistance as measured by ASTM D 4833 of 90 pounds of force at 73° F./23° C. The reinforcing mats used to reinforce these roofing membranes, to reinforce other roofing products, and to reinforce various laminates and membranes used for other non-roofing applications may be woven or unwoven mats of staple fibers and/or continuous filaments and include a binder that is evenly distributed throughout the mats to give the mats the required dimensional stability for a particular application. While these mats perform quite well as reinforcements for various laminates, membranes, etc., there is a need for lower cost dimensionally stable mats.

U.S. Pat. No. 5,865,003 discloses a reinforced glass fiber mat made in a wet process that has a predetermined pattern of relatively high and low concentrations of binder throughout the length of the glass fiber mat and a method of forming the mat wherein, in a wet process, binder is either selectively applied only to portions of the mat via an applicator or selectively removed from portions of the mat via a vacuum. However, the need remains for reduced cost reinforced fiber mats, with relatively high and low binder concentrations, which do not require the selective application or vacuum removal of binder.

SUMMARY OF THE INVENTION

In the method of the subject invention a mat, e.g. a polymeric fiber and/or continuous polymeric filament mat, of increased dimensional stability is made from a less dimensionally stable mat by adding binder to the mat. The dimensionally more stable mat is made from the dimensionally less stable mat by saturating the mat with a binder and subsequently passing and compressing the binder saturated mat between a pair of squeeze rolls (first and second squeeze rolls) to remove a portion of the binder from the mat. The surface of at least the first squeeze roll has a series of spaced apart annular grooves therein along the length of the roll and across the width of the mat whereby as the mat is passed between the squeeze rolls a first and a second series of longitudinally extending bands having different concentrations of binder are formed in the mat. The first series of bands, formed in the mat intermediate the annular grooves of the first squeeze roll, has a first average binder concentration. The second series of bands, formed in the mat at the annular grooves of the first squeeze roll, has a second average binder concentration higher than the first average binder concentration of the first series of bands. Subsequent to the formation of the two alternating series of bands in the mat, the binder within the mat is cured to form a dimensionally more stable mat.

The mat from which the dimensionally more stable mat of the subject invention is formed may be dry or wet laid, woven or nonwoven, and may be made with polymeric fibers and/or continuous polymeric filaments or other fibers and/or continuous filaments provided these other fibers and/or continuous filaments have sufficient flexibility and ductility to pass through the squeeze rolls without excessive breakage. A preferred mat utilized to form the dimensionally more stable mat of the subject invention, is a randomly laid mat of polymeric staple fibers and/or continuous polymeric filaments, such as a polyester continuous filament spunbond mat. For roofing product applications, when the mats of the subject invention are substituted for previously used mats having a uniform binder concentration throughout the mat, the roofing membranes produced from the mats should have a maximum linear dimensional change of plus or minus 2% as measured by ASTM D 1204, 6 hours at 158° F./70° C.; and a minimum puncture resistance as measured by ASTM D 4833 of 90 pounds of force at 73° F./23° C.

The second squeeze roll may also have annular grooves therein, aligned with the annular grooves in the first squeeze roll, to form the second series of bands in the dimensionally more stable mat with higher binder concentrations at and adjacent both major surfaces of the mat. All or selected annular grooves in one or both of the squeeze rolls may be discontinuous or vary in depth to vary the binder concentration along the lengths of the bands in the second series of bands. For example, the annular grooves in one or both squeeze rolls that regulate the amount of binder in the bands of the second series of bands formed adjacent the lateral edges of the mat may be continuous to provide the lateral edges of the mat with a greater binder concentration and a greater integrity along their entire lengths while the annular grooves that regulate the amount of binder in the second series bands intermediate the lateral edges of the mat may be discontinuous or vary in depth to periodically reduce the amount of binder along the lengths of these bands as a cost savings.

DESCRIPTION OF THE PREFERRED EMBODIMENTS

The mat of the subject invention includes a first series and a second series of longitudinally extending bands having different average binder concentrations. The first series of bands has a first average binder concentration. The second series of bands has a second average binder concentration that is greater than the first average binder concentration of the first series of bands. The binder is included in the mat to provide the mat with an increased dimensional stability and enables such mats to be utilized in applications for which the mats, without the added dimensional stability provided by the binder, would not be suited.

The mat 20 from which the dimensionally more stable mat of the subject invention is formed may be dry or wet laid, woven or nonwoven, and may be made with polymeric fibers and/or continuous polymeric filaments or other fibers and/or continuous filaments provided these other fibers and/or continuous filaments have sufficient flexibility and ductility to pass through the squeeze rolls utilized in the method of the subject invention without excessive breakage. Preferably, the fibers are polyester or polypropylene staple fibers and the continuous filaments are continuous polyester or polypropylene filaments. The fibers or continuous filaments in the mat may be thermoplastic or thermosetting. Typically, the staple fibers average from about 2.5 to about 10 centimeters in length. Typically both the staple fibers and the continuous filaments have a denier between 2.5 and 6.5, but may have a denier ranging up to about 15. A preferred mat 20 utilized to form the dimensionally more stable mat of the subject invention, is a randomly laid mat of polymeric staple fibers and/or continuous polymeric filaments, such as a polyester continuous filament spunbond mat.

Figure 1:
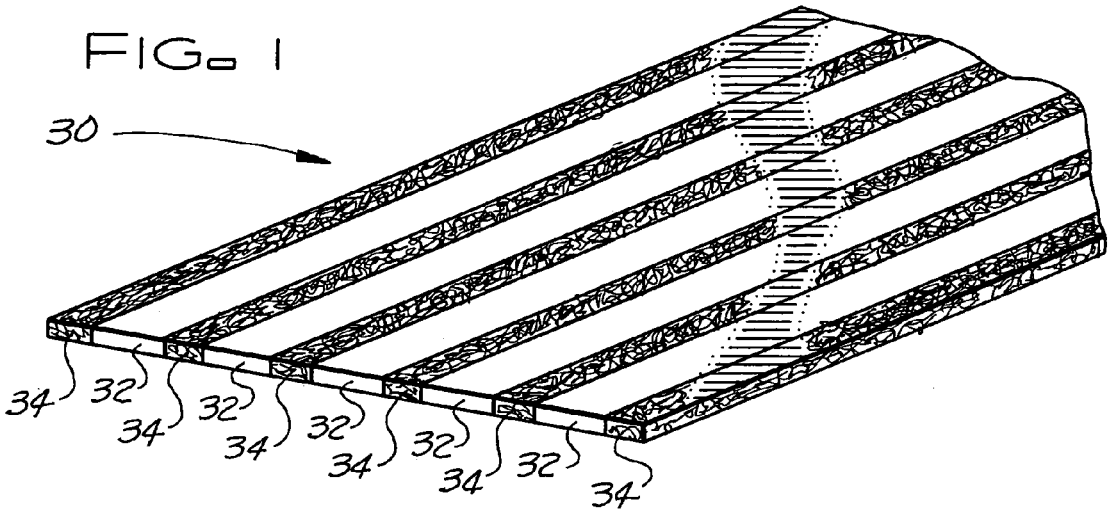
FIG. 1 is a schematic perspective view of a mat of the subject invention with a first series of longitudinally extending low binder concentration bands separated by a second series of longitudinally extending high binder concentration bands.

FIG. 1 shows a first embodiment 30 of the mat of the subject invention. The mat 30 includes a first series of longitudinally extending bands 32 (the unshaded bands) having a first average binder concentration and a second series of longitudinally extending bands 34 (the shaded bands) having a second average binder concentration that is greater than the first average binder concentration of the first series of bands. Preferably, a longitudinally extending higher binder concentration band 34 of the second series of bands extends along each lateral edge of the mat 30 to provide the longitudinal edges of the mat with greater integrity. The mat 30 typically has an average thickness between 0.5 and 1.5 millimeters and a dry weight between 100-grams/square meter and 600-grams/square meter. The widths of the lower binder concentration bands 32 and the higher binder concentration bands 34 are selected to provide the mat 30 with the required dimensional stability for a particular application. However, where the mat 30 is placed under tension in subsequent manufacturing operations, such as in the production of roofing membranes, the center-to-center spacings of and the widths of the higher binder concentration bands 34 should be selected to avoid forming longitudinally extending corrugations in the mat as the mat is placed under tension during these subsequent manufacturing operations. For use as a reinforcing layer in roofing products, it is contemplated that: the width of the higher binder concentration bands 34 of the second series of bands should be between ⅛ of an inch and ¼ of an inch and the center-to-center spacings of the bands 34 should be between ⅜ of an inch and 1 inch, and the widths of the lower binder concentration bands 32 should between ⅛ of an inch and ⅞ of an inch.

Preferably, for applications such as a reinforcement for roofing products, the average binder concentration, as a weight percentage of the dry weight of the mat band, for the first series of longitudinally extending bands 32 in the mat 30 is less than 15% by dry weight with a preferred weight range being between about 0.5% and 10% by dry weight and a more preferred weight range being between about 0.5% and 5% by dry weight. Preferably, for applications such as a reinforcement for roofing products, the binder concentration, as a weight percentage of the dry weight of mat band, for the second series of longitudinally extending bands 34 in the mat 30 is greater than 15% by dry weight with a preferred weight range between 15% and 30% by dry weight.

Various commercially available binders may be used to bond the fibers and/or continuous filaments together within the mat 30 and within other mats of the subject invention, such as but not limited to acrylic latex binders and styrene butadiene binders. A preferred binder utilized in the mats 30 and other mats of the subject invention that reinforce roofing products is acrylic latex such as an acrylic latex binder sold by Omnova Solutions under the trade designation "GEN-CRYL 9000".

Figure 2:
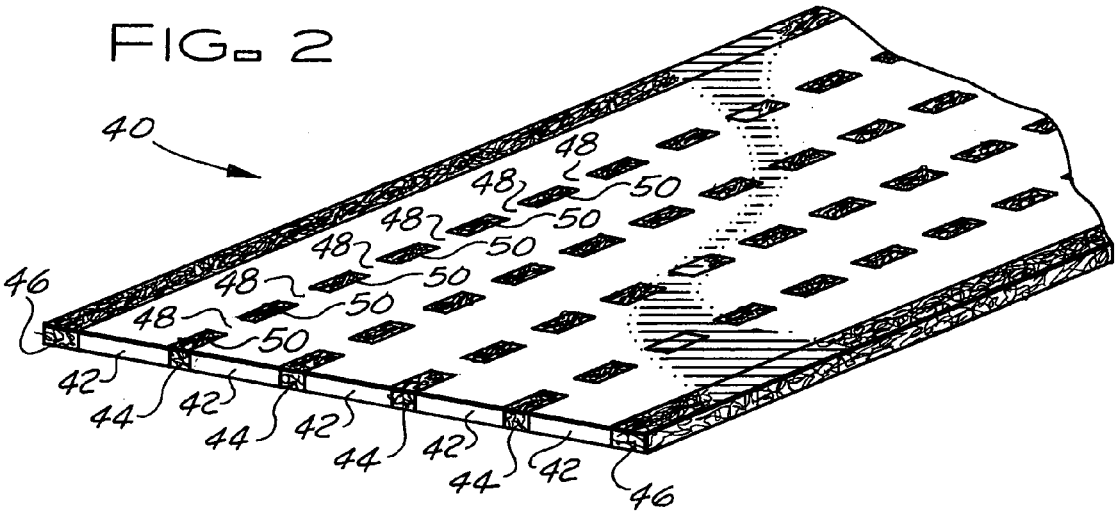
FIG. 2 is a schematic perspective view of a mat of the subject invention wherein bands of the second series of bands intermediate the lateral edges of the mat have a variable binder concentration along the lengths of the bands.

FIG. 2 shows a second embodiment 40 of the mat of the subject invention. The mat 40 includes a first series of longitudinally extending bands 42 (the unshaded bands) having a first average binder concentration and a second series of longitudinally extending bands 44 and 46 (the shaded bands) having a second average binder concentration greater than the first average binder concentration of the first series of bands. The longitudinally extending higher binder concentration bands 44 of the second series of longitudinally extending bands have a binder concentration that varies along the length of the band and the longitudinally extending higher binder concentration bands 46 of the second series of bands have a substantially uniform binder concentration throughout their entire lengths. As shown, each higher binder concentration band 44, intermediate the bands 46 extending along the lateral edges of the mat 40, includes a series of lower binder concentration portions 48 (the unshaded portions of the band) separated by a series of higher binder concentration portions 50 (the shaded portions of the band). The lower binder concentration portions 48 of the bands 44 may have a binder concentration the same as or differing from the binder concentration of the lower binder concentration bands 42. However, the average binder concentration of each of the bands 44 exceeds the average binder concentration of each of the bands 42. The relative lengths of the lower binder concentration portions 48 and the higher binder concentration portions 50 of the bands 44 and the widths of and spacing between the bands 44 are selected to provide the mat 40 with the desired dimensional stability. For example, the higher binder concentration portions 50 of the bands 44 may be between about ¼ of an inch and about 1½ inches in length and the lower binder concentration portions 48 of the bands 44 may be between about ¼ of an inch and 1½ inches in length and between ⅛ of an inch and ¼ of an inch in width with the center-to-center spacings of the grooves between ⅜ of an inch and 1 inch. With bands 44 of these widths and center-to-center spacings, the widths of the lower binder concentration bands 42 is between about ⅛ of an inch and about ⅞ of an inch. Other than the inclusion of lower binder concentration portions 48 and higher binder concentration portions 50 in the higher binder concentration bands 44 of the mat 40, the mat 40 is the same as the mat 30.

Preferably, for applications such as a reinforcement for roofing products, the average binder concentration, as a weight percentage of the dry weight of the mat band, for the first series of longitudinally extending bands 42 in the mat 40 is less than 15% by dry weight with a preferred weight range being between about 0.5% and ab10% by dry weight and a more preferred weight range being between about 0.5% and 5% by dry weight. The average binder concentration, as a weight percentage of the dry weight of mat band, for the second series of longitudinally extending bands 44 and 46 in the mat 40 is greater than 15% by dry weight with a preferred weight range being between 15% and 30% by dry weight.

Figure 3:
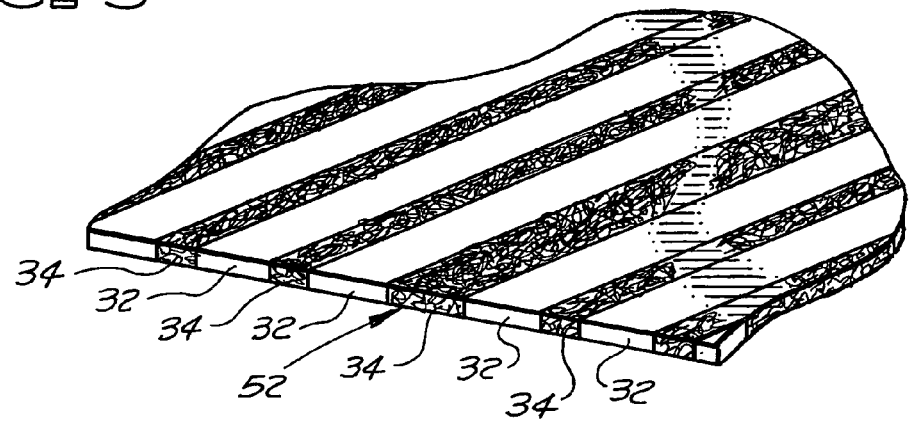
FIG. 3 is a partial schematic perspective view of a mat of the subject invention, prior to being cut into two mats, at the location where the mat will be severed.

Typically the mats of the subject invention are about one meter in width. However, these one meter wide mats are normally made from mats up to four meters in width that are cut longitudinally into mats of the desired one meter width. FIG. 3 shows a portion a wider mat, e.g. a four meter wide mat, at a location 52 where the mat will be severed longitudinally to form two one meter wide mats 30. Preferably, at this location, the higher binder concentration band 34 in the four meter wide mat is at least twice the width of the other higher binder concentration bands 34 in the mat so that when the wider mat is severed longitudinally at 52, the high binder concentration bands along the lateral edges of the one meter wide mats formed from the wider mat will be as wide as the other higher binder concentration bands of the one meter mats.

Figure 4:
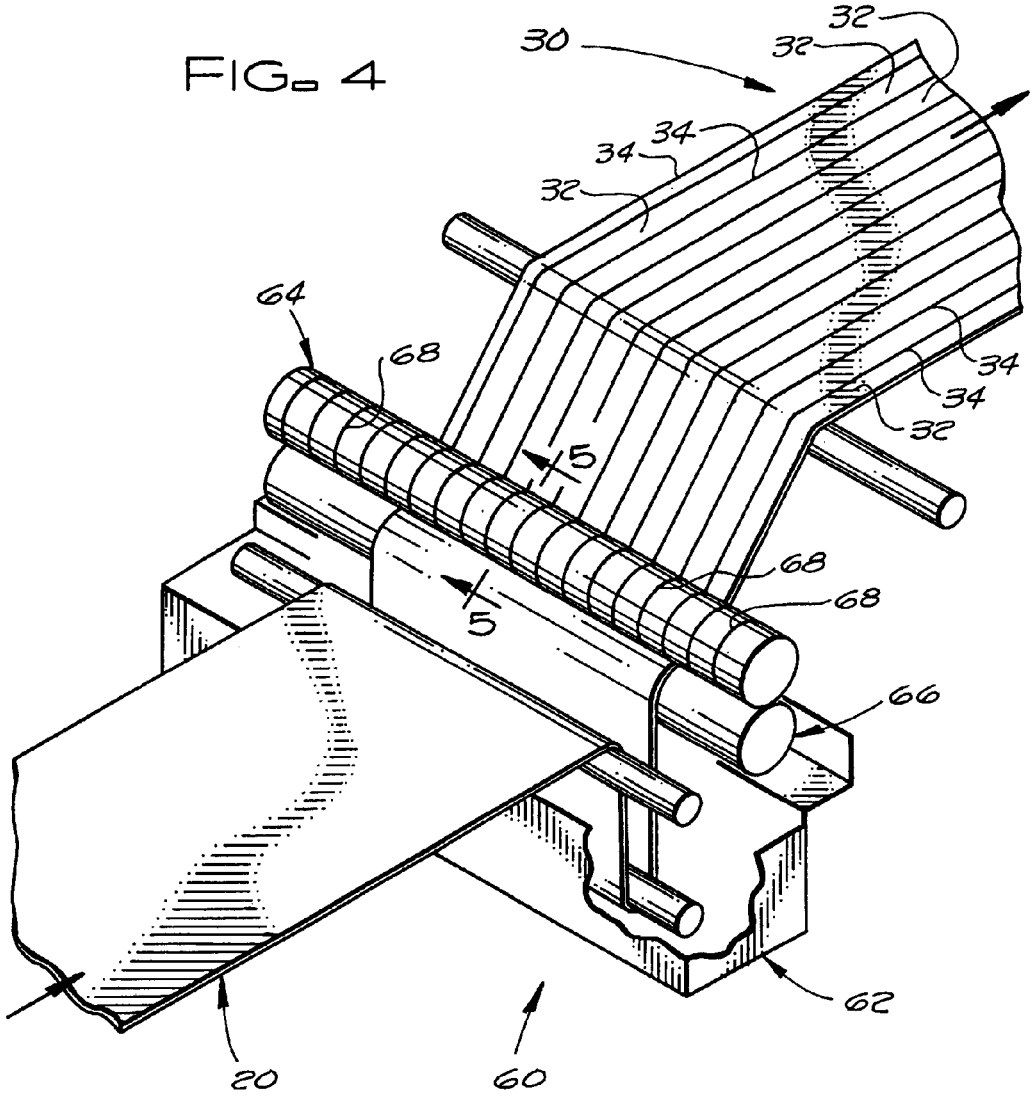
FIG. 4 is a perspective schematic view, with a portion broken away, of an apparatus of the subject invention for forming the dimensionally more stable mat of the subject invention by the method of the subject invention.

As shown in FIG. 4, the preferred apparatus 60 for use in the method of the subject invention includes a binder application or "dip" tank 62 and first and second squeeze rolls 64 and 66. A mat 20, such as but not limited to a polyester mat, is fed into the apparatus and passed through the binder application tank 62. In the binder application tank, the mat 20 is immersed in a pool of binder (not shown) and the mat 20 is saturated with the binder. Subsequent to passing through the binder application tank 62, the mat 20, now saturated with binder, is passed between the first and second squeeze rolls 64 and 66. At least the first squeeze roll 64 has annular grooves 68 therein for forming higher binder concentration bands 34 in the dimensionally more stable mat 30 produced on the apparatus. The spacing between the opposed cylindrical surfaces of the first and second squeeze rolls 64 and 66 is less than the uncompressed thickness of the binder saturated mat 20 and as the binder saturated mat 20 passes between the rolls, the overall binder concentration of the mat 20 is reduced. The exact spacing between the opposed surfaces of the first and second squeeze rolls 64 and 66 and the depths, widths and center-to-center spacings of the annular grooves 68 in the first squeeze roll 64 are selected to provide the mat 30 produced on the apparatus 60 with lower binder concentration bands 32 and higher binder concentration bands 34 of selected binder concentrations that provide the mat 30 with the required dimensional stability. Subsequent to passing between the first and second squeeze rolls 64 and 66, the mat 20, with its reduced overall binder concentration is passed through a conventional heat source or oven (not shown) to cure or dry the binder remaining in the mat or the binder remaining in the mat is otherwise permitted to cure or dry. The curing or drying of the binder remaining within the mat completes the bonding together of fibers and/or continuous filaments within the mat and results in the formation of the mat of the subject invention e.g. mat 30 shown in FIG. 1, with its increased dimensional stability.

Figure 5:
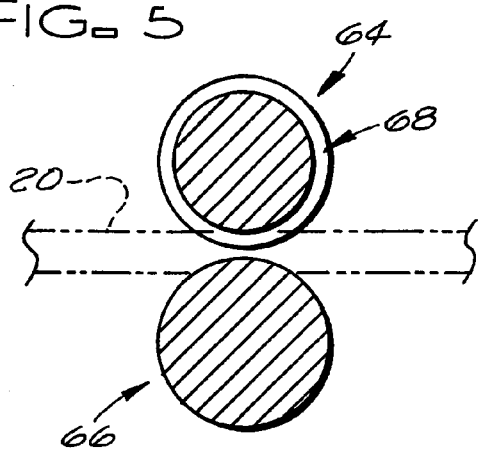
FIG. 5 is a cross section through the squeeze rolls of the apparatus of FIG. 4 taken substantially along lines 5-5 of FIG. 4 to schematically show the cross sections of the squeeze rolls at an annular groove in the first squeeze roll.

As schematically shown in FIGS. 4 and 5, the series of spaced apart annular grooves 68 in the first squeeze roll 64 are spaced apart from each other along the length of the cylindrical squeeze roll 64 and across the width of the binder saturated mat 20 being fed through the squeeze rolls 64 and 66. The annular grooves 68 are continuous grooves and form a dimensionally more stable mat, such as the mat 30 of FIG. 1, wherein the higher binder concentration bands 34, as well as the lower binder concentration bands 32, have a substantially uniform binder concentration throughout their lengths. The widths of the annular grooves 68 and the center-to-center spacings of the grooves 68 are selected to form the mat 30 with higher binder concentration bands 34 at spacing that provide the mat with the required dimensional stability for a particular application. For forming a mat to be used as a reinforcing layer in roofing products, it is contemplated that: the widths of the grooves 68 should be between ⅛ of an inch and ¼ of an inch and the center-to-center spacings of the grooves should be between ⅜ of an inch and 1 inch. With this groove width and spacing, the portions 70 of the squeeze roll 64 intermediate grooves 68 should between ⅛ of an inch and ⅞ of an inch in length. Typically, the grooves 68 should have a depth of about 1/16 of an inch. For other applications, the widths, depths and center-to-center spacings of the annular grooves 68 can be selected to provide the dimensionally more stable mat 30 with the dimensional stability required for the particular application.

Figure 6:
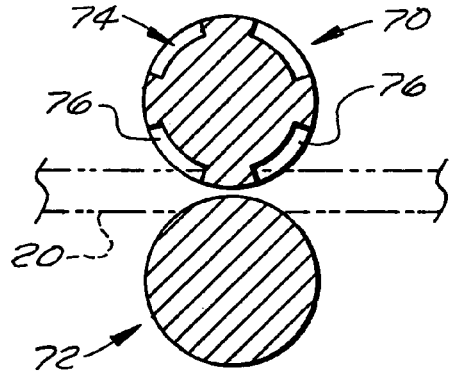
FIG. 6 is a cross section through the squeeze rolls of the apparatus of FIG. 4 taken substantially along lines 5-5 of FIG. 4 to schematically show the cross sections of a first pair of alternative squeeze rolls at an annular groove in the first squeeze roll.

FIG. 6 schematically shows an alternative pair of cylindrical squeeze rolls 70 and 72 that can be utilized in the apparatus 60 of the subject invention. The squeeze roll 70 has a series of discontinuous annular grooves 74. The discontinuous annular grooves are spaced apart from each other along the length of the cylindrical squeeze roll 70 and across the width of the binder saturated mat 20 being fed through the squeeze rolls 70 and 72. Each discontinuous annular groove 74 is formed by a series of annularly spaced apart depressions 76 in the surface of roll e.g. depressions having a depth of about 1/16 of an inch and a length between about ¼ of an inch and about 1½ inches that are spaced apart circumferentially between about ¼ of an inch and 1½ inches. With this groove configuration or structure higher binder concentration bands are formed in the mat such as the variable binder concentration bands 44 of the mat 40 of FIG.

2. The annular lengths of and spacing between the spaced apart depressions 76 of each discontinuous annular groove 74 may be varied and the widths, depths and center-to-center spacings of the discontinuous annular grooves 74 can be selected to form a dimensionally more stable mat on the apparatus 60 with the dimensional stability required for a particular application.

Figure 7:
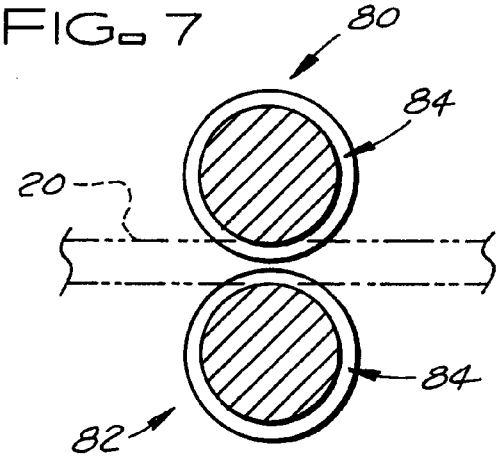
FIG. 7 is a cross section through the squeeze rolls of the apparatus of FIG. 4 taken substantially along lines 5-5 of FIG. 4 to schematically show the cross sections of a second pair of alternative squeeze rolls at opposed annular grooves in the squeeze rolls.

FIG. 7 schematically shows an alternative pair of cylindrical squeeze rolls 80 and 82 that can be utilized in the apparatus 60 of the subject invention. The squeeze rolls 80 and 82 have opposed annular grooves 84. The annular grooves 84 in the squeeze rolls 80 and 82 are continuous and have a uniform or a substantially uniform depth throughout their circumferential lengths. For example, the grooves 84 may have a uniform depth of about 1/16 of an inch. With this groove configuration or structure higher binder concentration bands are formed in the mat with high binder concentrations at and adjacent both major surfaces of the mat. The widths, depths and center-to-center spacings of the annular grooves 84 can be selected to form a dimensionally more stable mat on the apparatus 60 with the dimensional stability required for a particular application.

Figure 8:
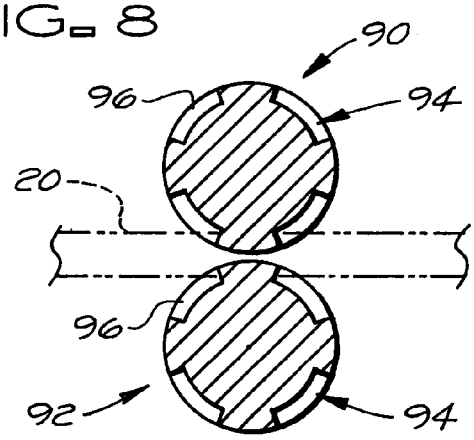
FIG. 8 is a cross section through the squeeze rolls of the apparatus of FIG. 4 taken substantially along lines 5-5 of FIG. 4 to schematically show the cross sections of a third pair of alternative squeeze rolls at opposed annular grooves in the squeeze rolls.

FIG. 8 schematically shows an alternative pair of cylindrical squeeze rolls 90 and 92 that can be utilized in the apparatus 60 of the subject invention. The squeeze rolls 90 and 92 each have a series of opposed discontinuous annular grooves 94. The discontinuous annular grooves of each squeeze roll are spaced apart from each other along the length of the cylindrical squeeze rolls 90 and 92 and across the width of the binder saturated mat 20 being fed through the squeeze rolls 90 and 92. Each discontinuous annular groove 94 is formed by a series of annularly spaced apart depressions 96 in the surface of roll e.g. depressions having a depth of about 1/16 of an inch. With this groove configuration or structure higher binder concentration bands are formed in the mat such as the variable binder concentration bands 44 of the mat 40 of FIG. 2. The annular lengths of and spacing between the spaced apart depressions 96 of each discontinuous annular groove 94 may be varied and the widths, depths and center-to-center spacings of the discontinuous annular grooves 94 can be selected to form a dimensionally more stable mat on the apparatus 60 with the dimensional stability required for a particular application.

Figure 9:
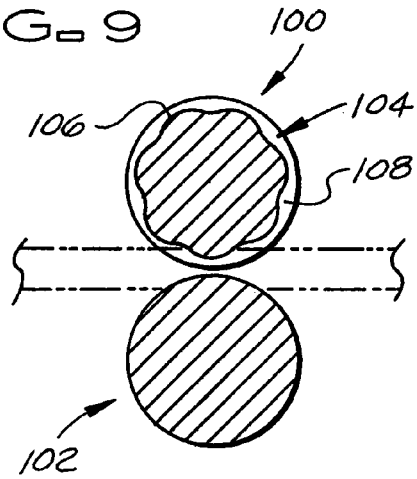
FIG. 9 is a cross section through the squeeze rolls of the apparatus of FIG. 4 taken substantially along lines 5-5 of FIG. 4 to schematically show the cross sections of a fourth pair of alternative squeeze rolls at an annular groove in the first squeeze roll.

FIG. 9 schematically shows an alternative pair of cylindrical squeeze rolls 100 and 102 that can be utilized in the apparatus 60 of the subject invention. The annular grooves 104 in the squeeze roll 100 vary in depth around the circumference of the squeeze roll with spaced apart portions 106 of the grooves having lesser depths than full depth portions 108 of the grooves. For example, the portions 106 of the grooves 104 may have depths of about 1/32 of an inch while the full depth portions 108 of the grooves 104 have a depth of about 1/16 of an inch. With this groove configuration or structure higher binder concentration bands are formed in the mat such as the variable binder concentration bands 44 of the mat 40 of FIG. 2. The relative annular lengths of the spaced apart lesser depth groove portions 106 and full depth groove portions 108 of the grooves 104 may be varied and the widths, depths and center-to-center spacings of the annular grooves 104 can be selected to form a dimensionally more stable mat on the apparatus 60 with the dimensional stability required for a particular application.

Figure 10:
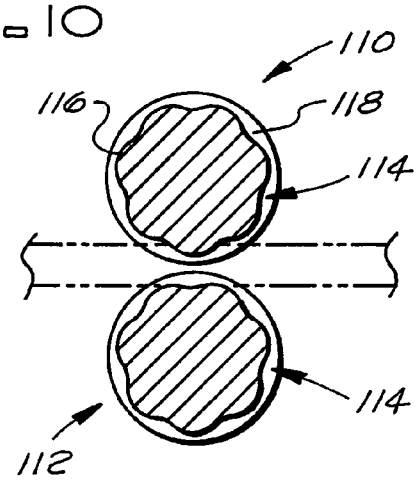
FIG. 10 is a cross section through the squeeze rolls of the apparatus of FIG. 4 taken substantially along lines 5-5 of FIG. 4 to schematically show the cross sections of a fifth pair of alternative squeeze rolls at opposed annular grooves in the squeeze rolls.

FIG. 10 schematically shows an alternative pair of cylindrical squeeze rolls 110 and 112 that can be utilized in the apparatus 60 of the subject invention. The squeeze rolls 110 and 112 each have a series of opposed annular grooves 114. The annular grooves 114 in the squeeze rolls 110 and 112 vary in depth around the circumferences of the squeeze rolls with spaced apart portions 116 of the grooves having lesser depths than full depth portions 118 of the grooves. For example, the portions 116 of the grooves 114 may have depths of about 1/32 of an inch while the full depth portions 118 of the grooves 114 may have a depth of about 1/16 of an inch. With this groove configuration or structure higher binder concentration bands are formed in the mat such as the variable binder concentration bands 44 of the mat 40 of FIG. 2. The relative annular lengths of the spaced apart lesser depth groove portions 116 and full depth groove portions 118 of the grooves 114 may be varied and the widths, depths and center-to-center spacings of the annular grooves 114 can be selected to form a dimensionally more stable mat on the apparatus 60 with the dimensional stability required for a particular application.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of increasing dimensional stability of a mat, comprising:

providing a mat; the mat having a length, a width and a thickness; the mat having first and second major surfaces defined by the length and the width of the mat;

saturating the mat with a binder;

passing and compressing the mat between first and second cylindrical squeeze rolls having opposed cylindrical surfaces spaced from each other a distance less than the thickness of the mat, with the cylindrical surface of the first cylindrical squeeze roll having annular grooves therein that are spaced from each other along the length of the first cylindrical squeeze roll and across the width of the mat, to remove binder from the mat and form in the mat a first series of longitudinally extending bands having a first average binder concentration and a second series of longitudinally extending bands having a second average binder concentration wherein the bands of the first series of longitudinally extending bands alternate with bands of the second series of longitudinally extending bands and the average binder concentration of the second series of longitudinally extending bands is greater than the average binder concentration of the first series of longitudinally extending bands; the second series of longitudinally extending bands being formed in the mat where the mat passes between the cylindrical squeeze rolls at the annular grooves in the cylindrical surface of the first cylindrical squeeze roil; and curing the binder to form a dimensionally more stable mat.

2. The method of increasing dimensional stability of a mat according to claim 1, wherein:

the mat is a nonwoven mat of staple fibers and/or continuous filaments.

3. The method of increasing dimensionally stability of a mat according to claim 1, wherein:

the mat is a nonwoven mat of polyester staple fibers and/or polyester continuous filaments; the mat has a thickness between 0.5 and 1.5 millimeters; the mat has a dry weight between 100-grams/square meter and 600-grams/square meter, and the binder is an acrylic latex binder.

4. The method of increasing dimensional stability of a mat according to claim 1, wherein:

the binder concentration by dry weight of the bands of the first series of longitudinally extending bands formed in the mat is less than 15%; and the binder concentration by dry weight of the bands of the second series of longitudinally extending bands formed in the mat is greater than 15%.

5. The method of increasing dimensional stability of a mat according to claim 1, wherein:

the binder concentration by dry weight of the bands of the first series of longitudinally extending bands formed in the mat is between 0.5% and 10%; and the binder concentration by dry weight of the bands of the second series of longitudinally extending bands formed in the mat is between 15% and 30%.

6. The method of increasing dimensional stability of a mat according to claim 1, wherein:

the binder concentration by dry weight of the bands of the first series of longitudinally extending bands formed in the mat is between 0.5% and 5%; and the binder concentration by dry weight of the bands of the second series of longitudinally extending bands formed in the mat is between 15% and 30%.

7. The method of increasing dimensional stability of a mat according to claim 1, wherein:

the annular grooves are discontinuous and the bands of the second series of longitudinally extending bands vary in binder concentration along the lengths of the bands.

8. The method of increasing dimensional stability of a mat according to claim 1, wherein:

the annular grooves vary in depth and the bands of the second series of longitudinally extending bands vary in binder concentration along the lengths of the bands.

9. The method of increasing dimensional stability of a mat according to claim 1, wherein:

the mat is saturated with the binder by immersing the mat in the binder.

10. The method of increasing dimensional stability of a mat according to claim 1, wherein:

the cylindrical surface of the second cylindrical squeeze roll has annular grooves aligned with the annular grooves in the cylindrical surface of the first cylindrical squeeze roll; and the bands of the second series of longitudinally extending bands formed in the mat have thin layers of binder on the first and second major surfaces of the mat.

11. The method of increasing dimensional stability of a mat according to claim 1, wherein:

bands of the second series of longitudinally bands are formed at lateral edges of the mat.

* * * * *